US006159569A

United States Patent [19]

Hansen

[11] Patent Number: 6,159,569

[45] Date of Patent: Dec. 12, 2000

[54] DECAL ORGANIZATION TOOL

[76] Inventor: Roger A. Hansen, R.R., Centerville, S. Dak. 57014

[21] Appl. No.: 08/734,785

[22] Filed: Oct. 22, 1996

[51] Int. Cl.[7] ..... G09F 3/00

[52] U.S. Cl. ..... 428/40.1; 283/81; 283/94; 283/108; 428/41.6; 428/41.8; 428/42.1; 428/42.2; 428/42.3; 428/914

[58] Field of Search ..... 428/40.1, 41.8, 428/41.6, 42.1, 42.2, 42.3, 914; 283/81, 94, 108

[56] References Cited

U.S. PATENT DOCUMENTS

| | | | |
|---|---|---|---|
| 2,783,172 | 2/1957 | Avery | 428/42.1 |
| 5,129,682 | 7/1992 | Ashby | 428/42.1 |
| 5,346,259 | 9/1994 | Mocilnikar et al. | 283/108 |
| 5,348,780 | 9/1994 | Boggs | 428/42.3 |
| 5,389,476 | 2/1995 | Kruchko | 428/41.6 |
| 5,510,171 | 4/1996 | Faykish | 428/195 |

*Primary Examiner*—Nasser Ahmad
*Attorney, Agent, or Firm*—Moore & Hansen

[57] ABSTRACT

A decal organization tool for products needing large numbers of decals utilizes a single large sheet on which all product decals for a specific product or product model are carried. The invention includes a means by which the previously unavoidable irregular margins surrounding the decals are effectively hidden from the eye and allows large sheet printing of decals with an aesthetically satisfactory overall appearance. An irregularly zone is added to the edge of each decal, and along with an ultraviolet responsive additive placed in the decal adhesive, allows the decal to form an indelible footprint on the product to which it is applied. The footprint, invisible to the eye, becomes visible under ultraviolet light, allowing identification of a specific decal and proof of its application to a product, even when the decal is no longer on the product.

27 Claims, 4 Drawing Sheets

DECAL ORGANIZATION TOOL

BACKGROUND OF THE INVENTION

The invention relates to the field of decal manufacturing and use and provides a decal organization tool and process which solves a wide range of long existing and unaddressed problems.

Many products produced by industry are sufficiently complex, and sometimes even potentially dangerous to a customer, that numerous safety messages, warning signs, instructions and other notices must be affixed to the product before sale. In addition, most products carry signage on which the manufacturer is identified, its trademark and model numbers are set forth, and relevant patent numbers presented. In some situations, the signage will include decorative striping, manufacturer logos and the like. Typically such warning and information signs are associated with the product by a substantial number of individual decals which are applied to the product at appropriate locations on the product, and all such signage will be referred to hereafter as decals or decal messages. As examples of the types of products requiring multiple decal messages, hazardous products such as large tools and machines, construction equipment such as front-end loaders, tractors, stump grinders, lift trucks, highway construction vehicles and the like will commonly carry six to twenty-five or even more decal messages in accomplishing these purposes. If a manufacturer produces more than one product or model, the number of required individual signs used by the manufacturer may be multiplied by the number of products or models. If the product is sold in foreign language speaking countries, the number of signs may be multiplied again by the number of such foreign languages.

The importance of all such decal messages being applied to the product is high. In some product situations, failure to attach a key warning or instruction sign may result in serious customer injuries and substantial product liability damages being assessed against the product manufacturer. In recent years, increasingly stringent requirements established by OSHA have mandated that certain information and warning signs be present. Consequently it is now more important than ever that a manufacturer be certain that all the required warning and instruction signs be constantly in inventory and consistently applied to the product before shipment. Using the tools and processes of prior art decal manufacturing, it has not been possible to achieve such consistency, and human error is a frequent problem.

Generally all such signage has been applied to the product in the form of individual decal messages, and the decisions to create and place particular decal messages on a product are usually generated at different times and come from either government requirements or different business departments of the manufacturer, some messages being generated from the engineering department to assure that operating instructions are understandable, others coming from the marketing department to enhance the appearance and attractiveness of the product, and still others originating from legal departments to provide legal notices and to warn customers of potential dangers and avert later product liability losses.

Typically specific product signage needs are recognized gradually over a long period of time, and consequently the decal messages are ordered at different times as new needs evolve or are recognized, and no one person at the manufacturer's facility becomes involved in assessing the total picture of all decal messages used by the manufacturer or for compatibility or consistency among the decal messages.

Decal purchase decisions generally result in multiple, isolated orders to one or more outside decal manufacturers who will seldom know anything more about the decal message or the reasons for it other than that the particular decal message has been ordered. The product manufacturer's purchasing director will seldom have time to concern himself with compatibility or consistency between existing decals, or the problem of reliable and consistent application of the decals to the product. The task of installing decals is usually assigned to the newest and least experienced employees, who are not qualified to assess a decal program. Often a minimum wage salary is paid to the installer of the decals on the theory that little skill is required for the job. However, any significant failure by this often new employee to affix all the critical decals to the product can result in staggering legal damages in the event of death or serious injury of a customer.

Generally most now used individual decal messages carry their own company stock number and are usually separately inventoried and separately restocked like all other machine parts by the product manufacturer's purchasing agent. As decal messages are used up and restocking occurs, individual suppliers of the decal messages begin to change, and the decals change in size, shape, and in color shades. Eventually the many decals used on a single product no longer have harmonious matching colors.

Size and shape differences in the corners of signage occur as a result of decals being manufactured at different times from different bidders. A first decal manufacturer may produce a particular decal with square corners. The next bidder may produce the same decal with corners featuring a quarter round having a particular radius. Later manufacturers may use a different radius with the quarter round. The result is increasing incompatibility between signage that comes together on a single product.

Although the manufacturer of a product generally wishes to have the colors of his signage be matching and aesthetically pleasing, as individual decals are reordered at various times and from changing suppliers, colors on new printed signs will inevitably evolve to shades and hues different from the original and the differences will be increasingly perceptible.

A more serious and frequently encountered problem with prior art decals is that of obtaining an aesthetically pleasing outer margin around the border of the decal message. Typically a decal message will include text which is centered within a line-style interior border or other interior border. A thermal die cut is made outside the line border and ideally should be spaced equally outward from the line border at all locations around the border. Because the vinyl material on which most decal messages are printed is flexible and stretchable, the material tends to flex, stretch and slip unpredictably during the thermal die cutting process. Consequently the cut has usually been nonparallel to the border or unevenly spaced relative to the border. The larger the size of the vinyl sheet the greater is the degree of stretching and slippage. The unpredictable nature of this stretching makes it extremely difficult to consistently produce such decals without also producing an irregular margin. When such a decal is applied to a product of some specific color, the decal margin generally forms a sharp contrast area with the product, and the interior line border on the decal and its irregular spacing from the decal edge is further emphasized Most manufacturers would prefer all decals used on their carefully finished machines to be aesthetically pleasing, provided with even and attractive margins, and compatible with one another. Currently manufactured collections of separate decals used with multi-decal products cannot consistently achieve these goals. The invention provides an effective and inexpensive solution to this long existing problem of irregular margins.

Still another problem encountered with the use of commercially available decals is that the process of applying the decals to the product is unnecessarily complicated, slow, and imprecise. Typically when a product, such as a tractor, may require thirty or more decals, the employee charged with decal installation will first obtain a list of required decals and then go to an inventory site to obtain the decals. This usually unskilled employee must gather each of the thirty or more decals from thirty or more separate decal storage files, check identification of each decal against individual decal stock numbers on the list, open protective envelopes to inspect stored decals, reject dogeared or otherwise damaged decals, and still try to be sure that all the right decals are quickly gathered for the specific product.

The employee then must carry this collection of individual decals to the site where the decals will be applied to the product, risking the possibility of one or more of the decals being lost or misplaced between inventory site and application site. The employee must peel off the release liner sheet on each of the many decals and constantly properly dispose of all of the many slippery individual liner sheets. The employee usually peels the decals in groups of six or eight for his convenience. To carry the sticky decals and keep them separate, he commonly temporarily affixes the decals to his person or his clothing while he walks to the product and applies each individual decal to the product.

It is known that each time a decal's adhesive comes in contact with a surface other than the final product mounting surface, the adhesive becomes contaminated by such things as dirt, dust, fibers or body oils. As much as 20% of the potential adhesion can be lost in this way. With a perfectly applied decal having a five year outdoor use life, each such unnecessary contamination may shorten that use life by a year. In effect, it is desirable that the decals go directly from the release liner sheet to the product with minimal extra handling or touching of the decal adhesive to other objects. The invention provides an effective solution to these problems by consolidating all the decals associated with a specific product or model on a single large decal organization tool sheet which can be brought as one unit to the application site.

Although it is known to consolidate all the miniaturized decals associated with certain toys, such as model airplanes, onto a single small liner, consolidating the many separate decals used for large tools or vehicles is not being done. The need for such improvement has gone unrecognized even in industries manufacturing products requiring extensive informational and legal liability warning signage. A consolidated sheet of decals has been possible on certain toys because the related decals are small, principally decorative and encounter few of the challenges associated with instructions or warnings on products of the type described herein. The toy buyer or model builder deals only with installing the decals on a single toy model and does not encounter the many problems and time constraints faced by a decal installer on an assembly line.

As applicant developed the present invention, he encountered difficulty with the problem of thermal die cutting the multiple removal cuts that must surround the multiplicity of decals on a single large vinyl sheet. Such problems are not significant with small sheets of the type used with toys and models. Because it is difficult to consistently center the removal cut on a stretching, flexing vinyl sheet with even a single decal, it is still more difficult when many cuts must be made simultaneously on a large sheet with many decals and which flexes and stretches much more than a single individual decal. The inability to create visually attractive margins about the many decals when combined on a large sheet was a challenge that had to be addressed by the inventor in order to provide decal messages having borders and margins whose aesthetic appearance was acceptable.

As an installer applies the many separate prior art decals to the product, at times the decals will need to be applied in close proximity to one another. This condition occurs most frequently at a product location that has parts which are potentially dangerous or on a control panel of a vehicle or machine, and as many as six or more individual decals may need to be applied in a relatively small area. As such decals are individually applied, the installer will rarely have the time to assure that all of the decals are aligned, parallel to one another, and properly spaced. Often the decals are skewed, misaligned, and unevenly spaced from one another, creating a sloppy or poorly finished look to an otherwise potentially attractive product. The invention provides a solution to this problem.

Another problem with prior art decals is that a product manufacturer has no effective way to prove that a critical decal message was placed on the product in the assigned location at the time the product was shipped. This issue arises when a product is later involved in a death or injury, and a claimant contends that an essential instructional or warning decal was negligently omitted from the product. At present, product manufacturers have no persuasive, economically feasible way of confirming that all the decals were present when the product was shipped. In addition, the possibility exists that a victim, after being injured by a product which was shipped with a complete collection of decals, may remove the relevant decal so as to enhance a claim for product liability against the manufacturer. With these concerns in mind, it is desirable that product manufacturers be able to prove at a later date that an essential but now missing decal was placed on the product at the time of shipment. Prior to the invention there was no known reliable and economically feasible mechanism which solved this problem.

It is known to utilize various anti-theft, tramper proof labels for the purpose of protecting the integrity of price tags, pharmaceutical labels, identification labels for original parts to distinguish them from stolen or counterfeit parts, and for motor vehicle identification label purposes, but such anti-theft labels are quite complex, expensive and their surfaces commonly self destruct if tampered with. The surface of a critical informational or warning decal may occasionally encounter rough field treatment while in normal use and such a decal could not be allowed to self destruct during normal use without creating new liability problems. It is known to impregnate the adhesive of such an anti-theft pricing label with an additive which leaves a stubborn invisible residue on the product to which it is bonded and wherein the residue can be visually detected by shining an ultraviolet light source on the residue, even after the label has otherwise been wholly removed. As the ultraviolet light reflects from the location to which the label was attached, the outline of the label appears as a glowing footprint, but is otherwise not visually detectable by an observer. Use of such an additive compound is helpful, but does not in itself provide a means by which it can later be proven that a specific warning or instructional decal was ever present and does not differentiate one decal from another. This technique of utilizing ultraviolet light and an appropriate light sensitive additive on anti-theft labels of specialized layer construction is disclosed in U.S. Pat. No. 5,346,259 issued Sep. 13, 1994 and entitled Anti-Theft Label Construction.

In some highly important identification situations, such as identifying stolen motor vehicles, it is known to utilize a label which leaves an ultraviolet footprint as described above, and wherein the label, before application to the product has the vehicle identification number cut into the label by means of a series of lines or dots burned through the label with a laser beam to produce a series of numerals. As a result, the label, when applied to the vehicle, forms an invisible residue on the vehicle surface at the label location except for the open spaces which form the numerals. When the label is subsequently removed by a car thief the vehicle identification number can still be detected by shining ultraviolet light on the location where the label was earlier present. When the ultraviolet light is shined on the label position, the label footprint appears with the vehicle number being defined by dots or spaces on the footprint. These represent the areas of the footprint which do not contain the residue and thus contrast with the rest of the label footprint which contains the residue.

While such a label may be practical for the critical identification of a costly motor vehicle, the label system is quite complex, expensive to utilize and too costly to be economically feasible in relatively low cost, low bidder decal markets. The cost of assigning specific matrix dot codes and the laser cutting of those codes into a decal would not be economically feasible. In addition, the cutting of the decal by the laser would often be aesthetically unacceptable, and in outdoor use such cuts would increase exposure of the decal's adhesive to weathering and shorten the use life of the decal. The invention provides a new and inexpensive way to reliably identify specific decals even after their removal from the product.

SUMMARY OF THE INVENTION

The invention comprises a decal organization tool and process by which all existing decals associated with and required for a particular product or product model are consolidated onto a single large decal sheet, and the invention includes a process by which the problems associated with such consolidation are overcome. The invention also includes the use of an adhesive which leaves a permanent residue on the product and allows the manufacturer to identify every decal placed on the product even after the decals have been removed.

Using the teaching of the invention, all decal signs associated with a particular existing product using many separate decals are collected and assembled for manufacture as a new decal organization tool which includes a large decal sheet containing all of the separate decals thereon. Manufacturing such a collection of decals on a single sheet poses special problems which are solved by the invention. The decal tool provides a vehicle by which a decal installer can select one single composite decal sheet matched to the particular product and immediately have available all decals for the specific product. The employee thus avoids the many delays of the prior art, including the need to begin with a check list of required decals, locating the many separate decal inventory files, opening the various file storage envelopes to obtain each separate decal, inspecting for damaged decals, and transporting the collection of separate decals to the product without any loss of decals or errors in selection.

A second feature of the invention includes manufacturing the decal organization tool in a way which effectively conceals the unavoidable irregular margins which surround the many individual decal messages on the tool sheet. As explained elsewhere, it is challenging to manufacture a large vinyl decal sheet containing many vinyl decal messages due to the difficulty of consistently making the removal cuts around the various messages in a way that has the messages and the printed borders of the messages looking centered on each decal. Because the vinyl material expands, stretches and flexes unpredictably during thermal die cutting of the removal cuts, the coordination of all the removal cuts so as to consistently center them on all the printed decal messages is virtually impossible. The invention provides a way to make the decals appear to have visually perfect outer margins even when the cutting accuracy of the thermal die is hard to control.

In accord with the invention the many decals are imprinted on a single large vinyl sheet with intervening gaps positioned between the decals. The intervening gaps are filled with a color band having a color which is matched to the color of the product on which the decals will be mounted. Removal cuts are made in the decal sheet by thermal die cutting, with the removal cuts being placed in the intervening gaps. This results in each decal message being surrounded by a colored margin substantially matched to the product color so that when each decal is placed on the product any irregular margin between the decal border and the decal outer edge is effectively concealed by reason of the margin having virtually the same color as the product. In a variation of the invention, the intervening gaps may be left transparent so that the margin surrounding individual decal borders will be transparent and the color of the product will be visible through such transparent margin.

Another feature of the invention includes the decal being manufactured with an adhesive to which a special additive has been added. When the adhesive is applied to the product, the additive leaves a stubborn but invisible residue on the product's paint or on the product itself. The additive remains substantially permanently bonded to the paint or product, even after removal of the decal, and this invisible residue becomes visible to the eye as a glowing footprint when ultraviolet light is shined on the residue. Each decal may also be supplied with a unique pattern of protrusions or indentations at the edge of the decal, such protrusions or indentations defining an irregularity zone unique to each decal, and which appears as part of the glowing footprint to allow the specific decal message to be identified even after removal from the product. Consequently, when a critical safety or warning decal is removed from the machine, perhaps as a means to enhance a spurious product liability claim, one can readily determine by use of ultraviolet light on the product, that the particular decal was applied to the product at the time of shipping. Such evidence can be extremely valuable in exonerating a manufacturer from a claim that the manufacturer negligently failed to mark the product and warn a customer.

The invention includes a process by which an existing product with a significant number of separate decals has all its decals collected and those of its decals which are placed closely adjacent each other on a common surface of the product identified. A next step consolidates the messages of those closely adjacent separate decals to form at least one group wherein all of the decal messages making up the group are substantially perfectly aligned with one another and sized to perfectly fit the common surface. All of the decal messages, including the group or groups, is then printed on a single large decal sheet which includes all the decals associated with the product. A removal cut is provided around individual decal messages and a single removal cut provided around each consolidated group. This process allows a manufacturer to eliminate the installing of many closely adjacent separate decals on a common surface with the decals usually being misaligned and poorly spaced. Instead the described grouping of decal messages allows a single decal containing all of the grouped messages to be applied to the common surface as a unit, resulting in perfect alignment and spacing between the decal messages of the group, elimination of multiple decal applications, and a superior overall appearance.

These and other objects and advantages of the present invention will become apparent from the following detailed description thereof taken in conjunction with the accompanying drawings, wherein like reference numerals designate like elements throughout the several views.

DESCRIPTION OF THE PREFERRED EMBODIMENTS

Figure 1:
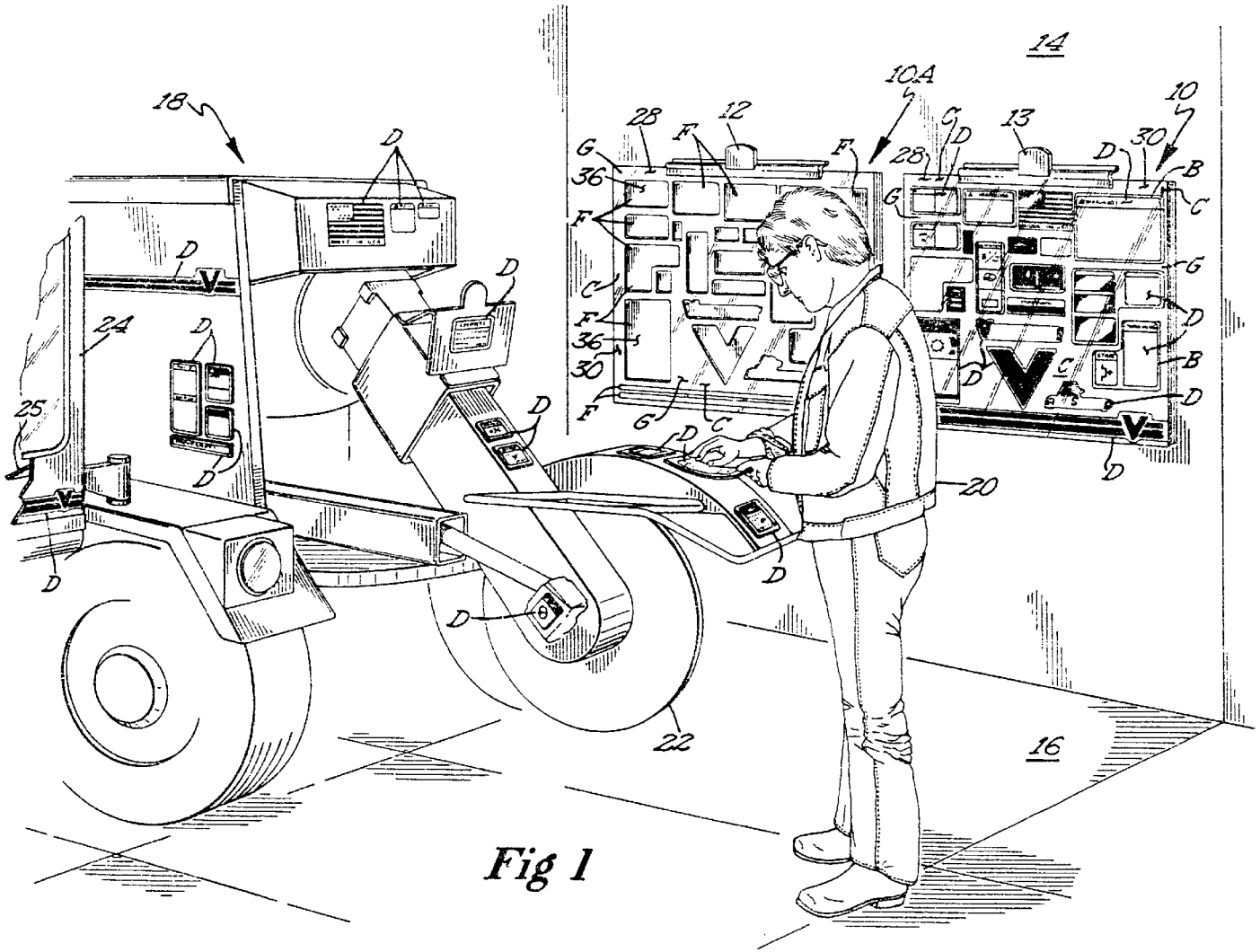
FIG. 1 is a perspective view of a product assembly line on which an employee is shown utilizing an embodiment of the decal organization tool invention to install decal messages on a product.

Referring now to FIG. 1 of the drawings, first and second decal organization tools 10 and 10A are retained by hangers 13 and 12, respectively on the wall 14 along the production line 16 of a hazardous product 18, here illustrated as being a tree stump grinding machine. FIG. 1 is illustrative of a hazardous product decal message application site where an employee 20 performs the tasks necessary to apply all the decals D associated with decal tool 10A, which are required to be placed on the stump grinder 18 prior to its sale and shipment.

It should be understood that the decal tools 10 and 10A each constitute an improved, enlarged and consolidated sheet carrying a multiplicity of decal messages D. The sheet associated with tool 10A has had all its decal messages D peeled off by employee 20 and applied to the product 18, leaving blank and empty frames F where decals were formerly carried. The sheet associated with tool 10 is shown as still complete and containing all the decals D originally present on tool 10A. The sheets used to carry the decals of tool 10 or 10A will typically be between 24" and 36" high and up to 48" long.

Many hazardous products of a complex or dangerous character, such as large tools and vehicles, require extensive decal signage. The stump grinder 18, with its large, powerful, rotating cutting disc 22 requires nearly twenty instructional messages and warning and safety signs. The employee 20 is responsible for proper placement of the specific decal messages. In accord with the invention, described further hereafter, each decal organization tool 10 or 10A comprises a large and improved decal sheet which includes virtually all the decals D required for the entire product 18. Accordingly, a total of approximately twenty or more decal messages D may be present on tool 10 when tool 10 is first delivered to the application site and hung at a convenient operating position on the wall 14 immediately adjacent the product 18.

While the stump grinder product 18 requires about twenty decal messages, it should be understood that other products may require a greater or lesser number of decal messages and that the size of the tool 10 and the number of decal messages carried thereon are to be matched to the needs of a specific product or product model. The application of each decal message D is important and at times may be crucial to allowing a customer to properly use the product 18 without harm to himself, others, or the machine itself.

The product 18 has a control center 24 which is provided with a control panel 25 (shown in part in FIG. 1) for its operator. Typically, such a control panel requires numerous decal messages, and the control panel and the particular messages associated therewith will be discussed, infra.

The product 18 has a paint coating 26 of a predetermined color selected by the product manufacturer and for purposes of illustration in this disclosure, the color will be presumed to be gold.

Figures 2, 3, 4:
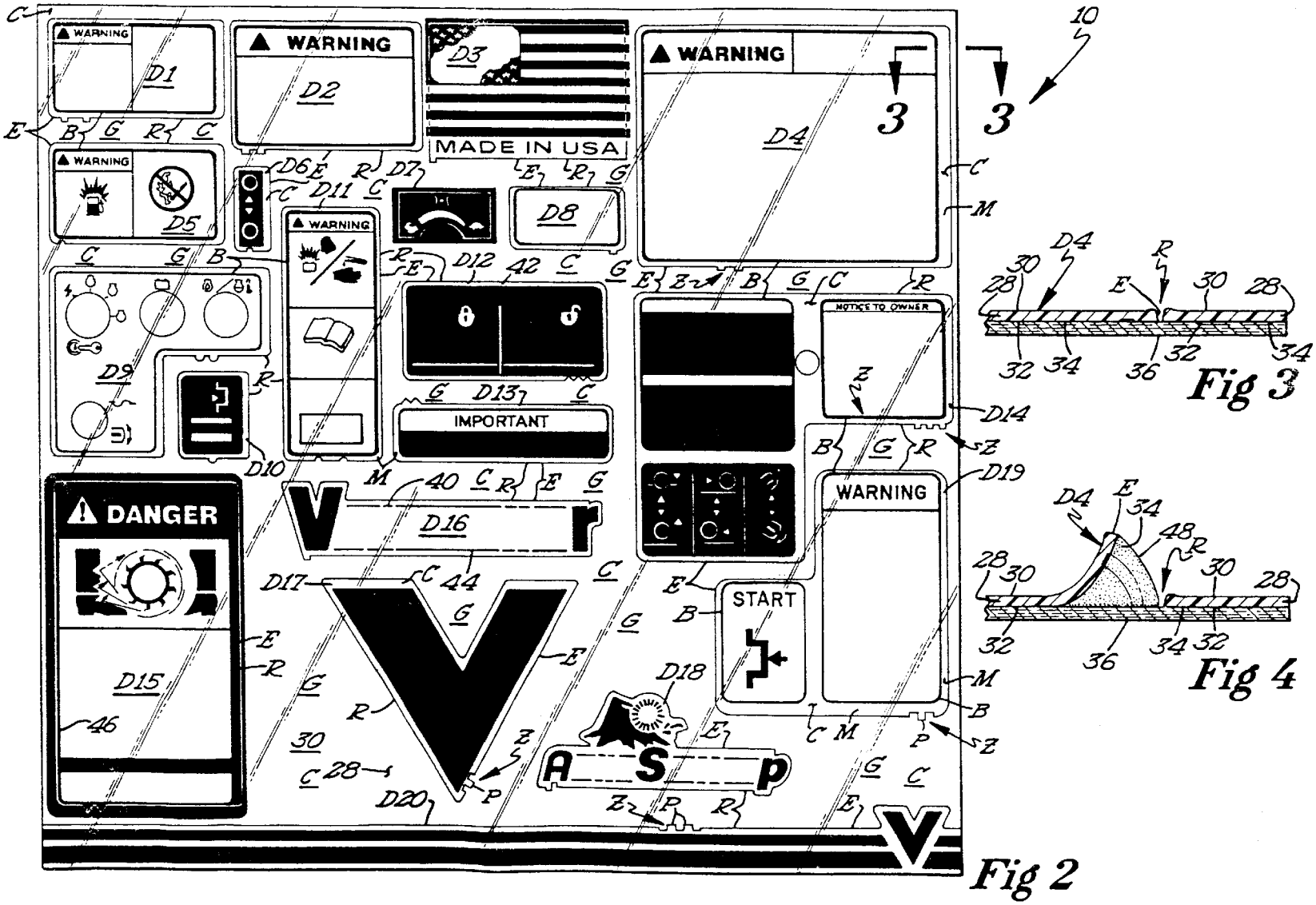
FIG. 2 is a top plan view of a decal organization tool containing a multiplicity of decal messages and embodying the invention.
FIG. 3 is a cross-sectional side view of a portion of the tool of FIG. 2 taken along cutting plane 3—3 of FIG. 2.
FIG. 4 is a cross-sectional side view like FIG. 3 and in which a decal message is shown partly removed from its liner sheet.

Referring now to FIGS. 2–4, the decal organization tool 10 is shown in larger detail disclosing the multiplicity of decals D1 through D20 carried by the tool 10 and to be applied to the product 18. The tool 10 utilizes an information layer 28 which will typically be a vinyl film having obverse and reverse faces 30 and 32 respectively. An appropriate decal adhesive 34 known to the art is applied to the reverse face 32 of information layer 28, and the adhesive 34 releasably retains a conventional decal liner sheet 36 which underlies the information layer 30.

The use of a releasable decal liner sheet is well known in the decal art, as are the types of adhesive utilized with such liners. In accord with the invention, it is desired that the adhesive be one which will adhere to the reverse face of a decal but allow the decal to be peeled by an employee installer 20 from the release liner 36 and still be sufficiently adhesive that when the decal is applied to the paint coating 26 of product 18 or to the product itself the decal will substantially permanently adhere to the product 18.

The information layer 28 of the tool 10 has a multiplicity of decal messages identified as D1 through D20 imprinted thereon, the decal messages being imprinted either on the obverse face 30 or the reverse face 32. It should be understood, however, that in accord with normal practice, when the message is imprinted on the reverse face 32, the layer 28 will be transparent and the image will require inversion to allow it being read by an observer facing the obverse face 30. It is frequently desirable to print the message on the reverse face of a transparent vinyl information layer so as to better protect the message from weathering when the decal is used in an outdoor environment.

Surrounding each decal message is a removal cut R (FIGS. 2–4) which separates the specific decal message from the rest of the information layer 28 but does not penetrate into the liner sheet 36. In making the cut R around each decal message, such cutting is done by thermal die cutting in which a hot cutting edge is applied to the area to be cut and thus effectively melts the vinyl of information layer 28 but does not damage the release liner sheet 36. The removal cuts R made by the thermal die cutting mechanism allow the employee installer 20 to pry the edge E of the decal messages upward to allow a corner 48 (FIG. 4) to be grabbed by the installer 20 and peeled off the liner sheet 36 to allow easy removal of a decal D4.

Each of the decal messages D1 through D20 shown on the information layer 28, such as decal D4, contains information which may include words, symbols, border treatments and sometimes decorative material. Often the decal message, such as message D4, has a border B around it. In the example of decal D4, the border B is a simple line border, and is also an "interior" border in that it is spaced inward from the removal cut R. Other decals, may have other border treatments. Decal D12 has a filled interior border 42 in which the border is literally defined by the darkened or colored background of the decal message. In a third type of border, illustrated in decal D16, (FIG. 2) the decal message may consist of words or symbols whose edges form no traditional geometric shape but have an overall locus of points 40 which collectively define a virtual border 44 extending between and including the "V" and "r" of the decal and the intervening letters. A fourth type of border 46, shown with decal message D15, is called a bleed border and is extremely popular. The bleed border 46 consists of a wide outer darkened border positioned around the decal message and wherein the border extends beyond the edge of the decal message D15. The removal cut R is made wholly within the width of the bleed border, causing the outer periphery of the message to be the color of the bleed border, usually black.

It is desirable in manufacturing decals to have the border B of each decal look centered and aligned with the outer edge E of the decal to achieve an overall pleasing aesthetic appearance. With prior art manufactured decals this goal cannot be consistently attained.

While it is desirable to have the information associated with each decal message perfectly centered within each removal cut R, the elastic and stretchable characteristics of the vinyl message layer 28 are such that the vinyl tends to expand, stretch and shift during printing and during thermal cutting, and consequently it is very difficult to consistently or predictably center the thermal die cutting tool on all of the decal messages D1–D20. With decals made using the teaching of the prior art, the removal cuts R are usually imperfectly centered on the borders B that surround the various messages. As a result of this inability to center an aesthetically pleasing removal cut, the margin which exists between the removal cut R and the border B is usually noticeably irregular. This irregularity may take the form of the removal cut R being nonparallel to the border B, or the spacing between one side of the border and edge E being unequal to that at an opposite side of the decal message.

Bearing in mind that it is difficult to obtain a perfectly centered border B even when die cutting a single vinyl decal, the difficulty of obtaining perfectly centered borders when multiple decals must be cut from a single large vinyl sheet is compounded and still more challenging.

With prior art manufacturing of individual decals, the imprinting is generally done on a commercially available information layer which is manufactured with a white base layer. When a prior art decal having the white base layer is applied to a product 18 (FIG. 5), an uneven white outer margin M surrounds each decal border B, such as with decal L2, and provides a sharp color contrast with the color of the product. Under such conditions, the flawed spacing associated with the irregular margin M and the off center border B are readily apparent to a viewer.

The need to provide decals with the appearance of substantially perfect centering has been addressed and solved by the present invention. Referring now to FIG. 2 and in accord with the invention, the intervening gaps G which exist on information layer 28 between the decals D1 through D20 and which surround the decals at the sheet edges are provided with a band of color C which is substantially identically matched to the predetermined color of the paint coat 26 or the general overall color of the product 18 in the case of nonpainted products. By providing such a color match C in the gaps G which extend between the borders B of all the decals, the color C fills the intervening gaps, and when the removal cuts R are thermally die cut around the decal messages, such color C is certain to fill the margin M between the removal cut associated with a particular decal and the border B associated with that decal as illustrated with decal D 19. When an employee 20 removes a decal from tool 10A to apply it to the product 18, the color C which fills the still irregular margin M surrounding the decal border B will substantially match the color 26 of the paint coat of the product, and the irregular margin M that would otherwise be visible to the viewer visually vanishes to the viewer eye. Because the color match between product paint coat and decal margin color C is substantially identical, the viewer notices only the vivid contrasting border B and the information within the border. Because the information is substantially perfectly centered within the border B, the decal message as a whole appears visually perfect. The invention thus addresses and solves the problem of visually displeasing irregular margins M which have been unavoidable in the thermal die cutting process and effectively conceals those irregular margins to the eye of the viewer, giving the visual impression of a perfectly prepared decal.

A variation of the invention is also able to achieve this result of visually concealing an irregular margin M by having the intervening gaps G between adjacent decals and which surround the decals at the edges of the sheet 28 be substantially transparent. By using transparency in such gaps, the decal, when applied to the product 18 has a transparent margin M between its removal cut R and its border B, allowing the viewer to see the product paint coat color through the transparent margin. This results in the irregular margin being effectively hidden, with the viewer's eye registering the vivid decal border B and the information within the border. This result can be obtained by utilizing a transparent vinyl film as information layer 28.

Use of a color band in the intervening gaps G, or alternatively the use of transparent vinyl material in those gaps constitutes a product match means which allows the viewer to see a color in the margin of each decal message which substantially matches the color of the product's paint coat 26 or the color of the product itself.

In another variation of the invention, the product match means may consist of the imprinting of a base color layer on one of the faces 30 or 32 of the information layer 28, such base color layer substantially matching the color of the paint coat 26 or the product color itself if the product is unpainted. The information required for the individual decal messages D-1–D20 and their particular borders are then printed on top of the base color layer so as to produce the desired decals D1 through D20 with the base color layer being visible in the gaps G. The thermal die removal cuts R are then applied to the various decals of tool 10. Accordingly the utilization of a base color layer which is substantially identical to the predetermined color of the product also constitutes a product match means and is within the purview of the invention.

In describing the invention, it has been stated that the color to be placed within the gaps G should be the color of the product 18. It should be understood that the term, color, as used herein may include black, white and gray scale variations as well as the traditional colors of the color spectrum.

Figure 5:
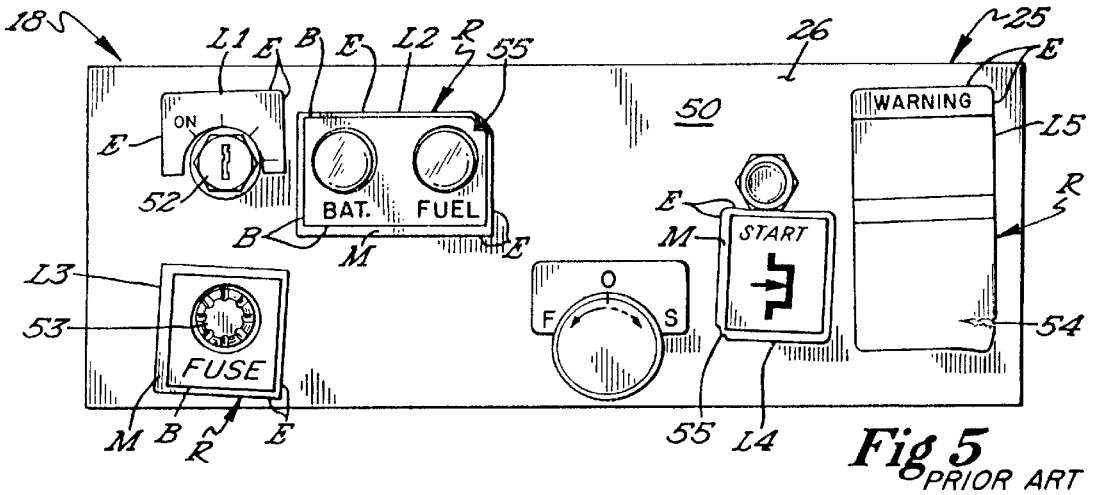
Fig 5 PRIOR ART
FIG. 5 is a top plan view of a control panel of the product shown in FIG. 1 and illustrating decals made and used in accord with prior at technology.

In appreciating a further feature of the present invention, it is helpful to understand other shortcomings of the prior art decals as best illustrated in FIG. 5. Prior to the invention, all the decals required on a given product were prepared as individual, separate decals wherein each decal was separately ordered, separately manufactured, separately inventoried and separately applied. FIG. 5 illustrates a control panel 25 associated with the control center 24 shown in FIG. 1. The control panel 25 has a common surface 50 on which various controls and indicators are located. Using the decals and decal technology of the prior art, a first decal L1 is applied to identify the operating positions associated with an ignition key switch 52. A second, separate and independent decal L2 is applied closely adjacent decal L1 to identify battery and fuel gages and has circular apertures which surround the gages. The decal L2 is difficult and time consuming to align with decal L1 and as a result will rarely have its border B or edge E parallel to the border or edge associated with decal L1, resulting in a poorly aligned, but closely positioned pair of decals whose misalignment is more glaringly apparent and aesthetically displeasing by reason of the close proximity. A third decal L3 is positioned to identify the fuse 53 of the control system, and will often be applied in a manner which results in its poor alignment with decals L1 and L2. In addition, decals L2 and L3 have traditional uncentered borders B which are not centered within the decal edges E and thereby also include irregular margins M which are visually obvious and further adversely affect the aesthetic appearance of the three decals.

Referring again to FIG. 5 the decals L4 and L5, positioned closely adjacent one another, also exemplify the difficulty of mounting closing adjacent decals in an aesthetically pleasing, aligned and parallel manner using prior art technology. Often a second attempt to reorient an initially crookedly applied decal such as L5 will result in the decal being torn as at 54, or in damage to a decal corner 55 as illustrated with decal L2 or L4.

Figure 6:
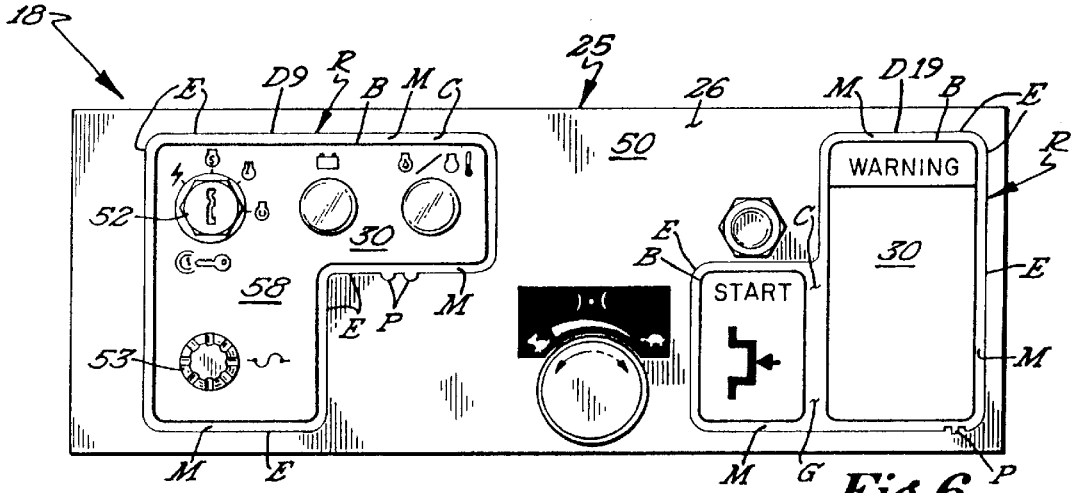
FIG. 6 is a top plan view of the control panel shown in FIG. 5 and illustrating decal messages embodying the invention.

The shortcomings of the prior art separate decals L1–L5 shown in FIG. 5 are solved by the invention as illustrated in FIG. 6. In accord with the present invention, all the decals which are needed by a particular product such as product 18 are first gathered. The collection of decals gathered are then examined and the decals which are applied to a common surface such as the surface 50 of FIG. 5 are identified. Where a plurality or multiplicity of decals are used on a common surface 50 and are also closely adjacent one another, as is the case for decals L1, L2 and L3 and also for decals L4 and L5, the invention consolidates such closely spaced decals into groups. As best illustrated in FIG. 6, the decals L1, L2 and L3 of FIG. 5 have been consolidated to define a single consolidated decal D9 containing all the information messages of decals L1, L2 and L3, having a single common line border B extending around all such messages and having a single removal cut R encircling the border B. It should be understood that the margin M between the border B and the removal cut R is filled by product match means such as a band of color C substantially color matching the predetermined color of the paint coating 26 of product 18. If desired, the color of the interior background area 58 may also be that of the product color C. Accordingly, when the decal D9 of FIG. 6 is placed on the common surface 50, all disharmonies, misalignments and nonparallel surfaces associated with the decals L1, L2 and L3 are effectively eliminated or are visually hidden. Labor time for installation is reduced by the application of a single decal D9 in place of three decals and the elimination of the stocking, gathering, liner removal time etc. associated with three decals.

Similarly, the closely adjacent decals L4 and L5 of FIG. 5 have been consolidated to form a group as new consolidated decal D19 which has an edge E thereabout and a single removal cut R and in which the intervening gaps, G between decal messages, are filled with a color C band matching the paint color of the product. The visual effect of the decal D19 is that of it appearing to the observer as if there are two closely adjacent separate, but perfectly aligned and applied decals like decals L4 and L5. As a result of the invention, the irregular margin M of the decal D19 blends with the product's overall color and visually vanishes.

Figure 10:
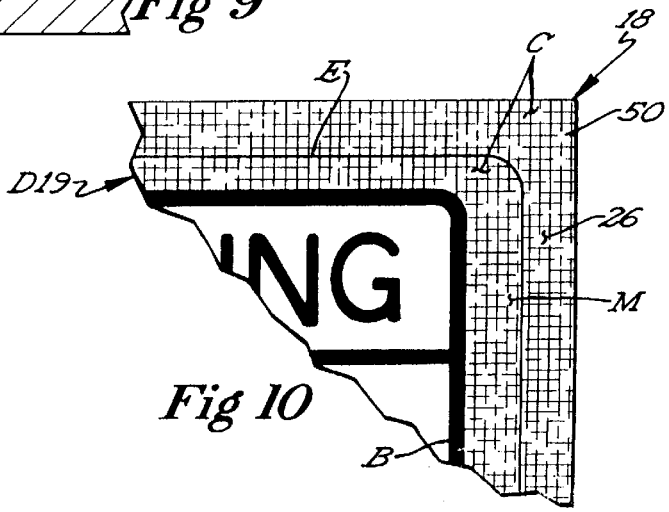
FIG. 10 is an enlarged top plan view of a decal message embodying the invention and applied to the product.

As best shown in the enlarged view of FIG. 10 when the decal message D19 is applied to the surface 50 of product 18, the predetermined color C in the irregular margin M, here shown as gold, substantially matches the gold color paint coat 26 associated with the product 18, thereby allowing what would otherwise be an irregularly configured margin M illustrated in FIG. 10 to remain virtually invisible to the eye while the main border B of the decal message D19 defines the visual edge of the decal message.

Figure 7:
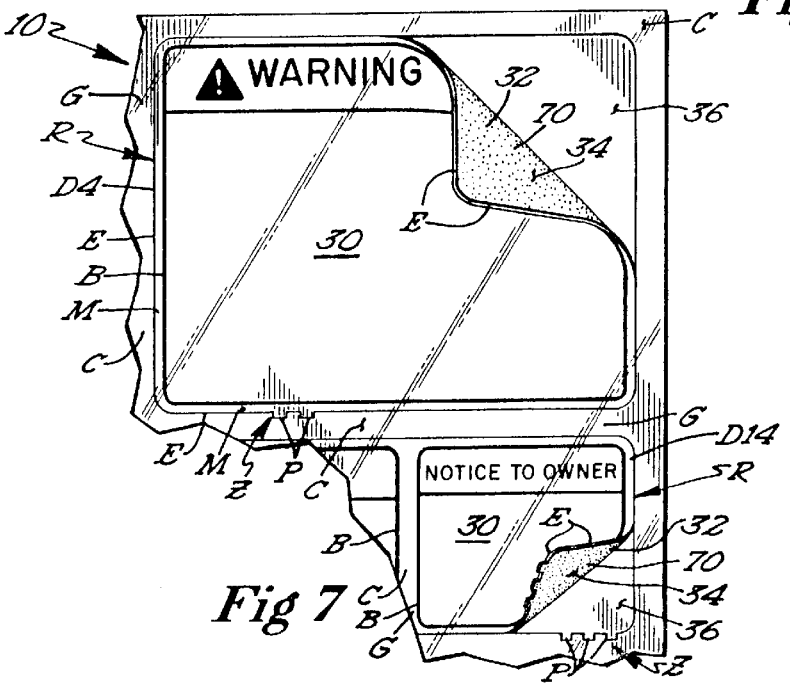
FIG. 7 is an enlarged view of a corner of the decal organization tool shown in FIG. 2 wherein decal corners are partially peeled back to illustrate a variation of the invention.
Figure 8:
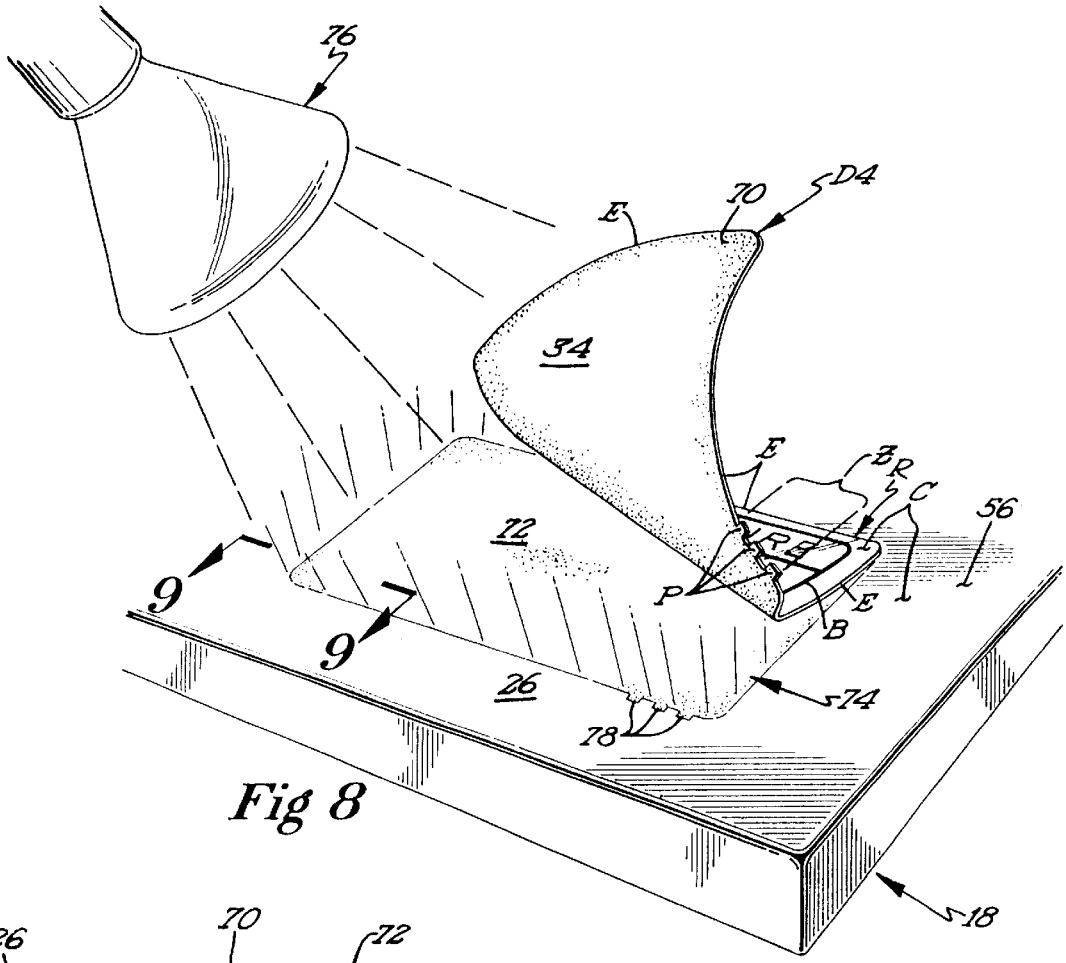
FIG. 8 is a perspective view showing a decal message embodying the invention and which has been applied and then partially removed from the product, and wherein an ultraviolet light source is used to display an otherwise invisible footprint created by the application of the decal message to the product.
Figure 9:
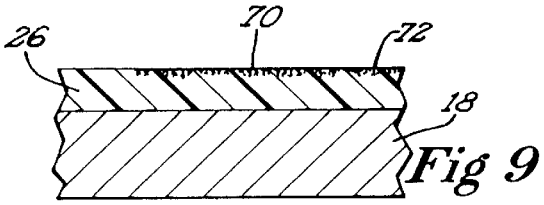
FIG. 9 is a cross-sectional side view of the footprint of FIG. 8 taken in the direction of cutting plan 9—9 in FIG. 8.

Referring next to FIGS. 7–9, a further variation of the decal tool 10 is illustrated wherein the adhesive 34 on reverse face 32 of the decal messages such as D4, D14, etc. is provided with a chemical additive 70 which when adhered to the paint coat 26 or to the product surface per se of product 18 forms a stubborn chemical residue 72 on or in the product surface or paint coat. In effect, the additive 70 when in contact with paint may soften the paint and be absorbed into the surface of the paint as best illustrated in FIG. 9 thereby permanently, virtually indelibly, leaving a residue 72 in the paint. The residue is preferably one which is not visible to the naked eye, but when it is exposed to an ultraviolet light source 76, will visually glow under the ultraviolet light, thereby defining a footprint 74 (FIG. 8) having the overall shape of the decal D4. By utilization of such additive 70, it is possible to later determine that specific decal D4, which was once on the product but later removed, was originally applied to that product.

Because of the growing need for manufacturer protection from spurious product liability cases, it can be crucial for a manufacturer to be able to prove that a particular and important warning or information decal message was applied to the product when it left the manufacturer's facility. By adding the described additive 70 to the adhesive 34, the chemical residue 72 becomes a permanent part of the paint coat 26 or of the product 18. If an unscrupulous claimant, after injury by the product, chooses to improperly remove a critical warning decal, such as D4, from the product so as to enhance his claim against the manufacturer, the footprint 74 left by that decal on the product can be readily detected under ultraviolet light, confirming that a decal was present at the footprint location when the product was shipped.

In selecting an appropriate adhesive and additive, it has been found effective to utilize a toluol, xylene, or other hydrocarbon based permanent clear acrylic adhesive in which an additive is dissolved, or mixed, one effective additive being a zinc sulfide solution containing traces of copper. This combination functions as an invisible die concentrate within the adhesive and shows up on the product as a blue footprint under ultraviolet light. In addition, fluorescing compounds disclosed in U.S. Pat. No. 5,346,259 supra, or other compounds known to the art may also be used to generate the footprint under ultraviolet light conditions. Any such additive capable of producing a substantially permanent residue on the product without visibly marring the product and which is visible under ultraviolet light is usable with the invention and within its purview.

It should be understood that the invention may be utilized effectively under some conditions using only the adhesive additive producing footprint described above, but there are also situations where it will be essential to prove that a specific decal message was positioned at a particular location on a product. Using only the adhesive and additive described above, and having that additive common to all decal messages on a product, allows one to identify the location and shape of all such applied decal messages but not necessarily to identify and distinguish one identically shaped decal message from another. To accomplish the latter, the invention includes a further feature in which each decal message may be provided with a unique irregularity zone Z illustrated in FIGS. 2 and 6–8.

Referring now to FIG. 7, the removal cuts R of decals D4 and D14 are substantially regular and continuous at all portions of the removal cut except for an irregularity zone Z in which one or more protrusions P, unique to each particular decal message is positioned. The combination of protrusions and the spacing between the protrusions allow the creation of a specific footprint unique to each decal message. It should be understood that the reverse face 32 of each of the protrusions P is like the reverse face 32 of the decal message, being provided with an adhesive 34 containing the ultraviolet light sensitive additive 70 described earlier. Consequently a decal such as D4 or D14 having a specific, unique irregularity zone Z will also produce a footprint 74 on the product to which it is adhered, and the footprint will have an outline matching the edge of the decal message and displaying the contour of its irregularity zone. This structure allows each applied decal to be uniquely identified even after the decal is wholly removed and all visible trace of it disappears to the eye under normal light conditions.

The irregularity zone Z may be made up of the protrusions P described in association with FIG. 7 and having particular combinations and spacing or can instead utilize indentations having varying combinations and spacing as illustrated in FIG. 2 by decals D11, D6 and D14. In addition, combinations of protrusions and indentations, such as illustrated in decal D17 of FIG. 2 may also be used and are within the purview of the invention. While certain of the decal messages have been shown as having protrusions which are square, it should also be understood that the protrusions may take other forms such as triangular protrusions shown in decals D15 of FIG. 2 or generally constant radius protrusions like those shown on decals D9 and D10 of FIG. 2. All such combinations are within the purview of the invention.

A further arrangement in which the decal messages can be readily identified and coded is to position the protrusions P (or indentations) at regular spaced intervals along the edge E wherein a protrusion or an unoccupied protrusion space appears at each potential protrusion location. If one views the presence or absence of a protrusion at a given location as the equivalent of a binary one or zero, it is possible to generate a binary number unique to each decal message by having a series of regularly positioned protrusions or empty spaces which cooperate to form the binary sequence. As will be recognized by those having ordinary binary skill in the coding art, the protrusion may readily be replaced with an indentation or a protrusion of a different configuration.

Referring again to FIG. 8, a surface 56 of the product 18 has had a decal message D4 thereon with the decal D4 and its adhesive being shown as now being partly removed from the surface. Even after removal of decal D4 and its adhesive, an invisible residue 72 will remain embedded in or on the paint coat 26 or to the surface of the product, and when ultraviolet source 76 is shined on the surface 56 a glowing footprint 74 becomes visible to an observer. The footprint 74 will include a replication 78 of the irregularity zone Z by displaying the contours of the protrusions P as illustrated in FIG. 8. The presence of the detectable footprint 74 and the particular combination of protrusions P allow an investigator to conclusively identify the message D4 as having been present on the product surface 56 even after its complete removal from the product.

In operation, the invention has many advantages. Its utilization begins with an inspection by the decal manufacturer of the product or products such as product 18 of a manufacturer in order to identify the specific collection of decals which are associated with each distinct product or model of product being manufactured and the location on each product where each specific decal is applied. The decal manufacturer then designs a decal organization tool 10 for one or more specific products or product models with the tool 10 including all the decals for the particular product or model so that the multiplicity of decals used by that product or model will be on a single decal tool sheet, can be purchased as a unit, inventoried as a unit, restocked as a unit, and transported from decal storage site to decal application site as a unit, thereby eliminating extensive labor and the many possible errors formerly associated with those steps. When the decal messages are to be applied to the product 18, the installer 20 brings two of the decal organization tools 10 and 10A containing the decal messages for the particular product to the decal application site as shown in FIG. 1. Both sheets are placed in an easily accessible and visible location adjacent the product. The employee 20 then removes decals D from only one of these sheets, such as the left most one 10A, and applies them to the product until all decal messages on that sheet 10A have been used. After application, the presence of the sheet 10A, completely devoid of all decal messages, is conclusive to the employee 20 as showing that all the decals have been applied to the product.

After the sheet 10A has been emptied of decals, the spaces formerly occupied by the decals are now empty frames F. These empty frames F are of the color, usually white, of the release liner sheet 36, and each frame is typically surrounded by a color band C which fills the gaps G on each sheet 10. This color band C vividly contrasts with the white of the liner 36 and provides a highly visible highlighted indicator to the installer 20 that all decals on the tool 10A have been used. The sharp contrast between liner sheet 36 and color band C in the gaps G surrounding the frames F allows the installer 20 to quickly scan the sheet 10A and easily confirm that the decal application task for the particular product 20 is complete. If decal messages remain on the sheet, the installer knows the installation task is not complete.

The second decal tool 10 is kept in immediately readiness in the event that one or more of the decals from the first decal tool 10A are damaged or torn during installation, but is not otherwise used. Over the course of a day or more, an increasing number of the extra decal messages on sheet 10 will be consumed as normal installation errors damage an occasional decal. After the extra decals on sheet 10 have been seriously depleted, a further "reserve" sheet 10 will be brought to the application site.

As the decal maker prepares the decal organization tool 10, the decal maker identifies specific decals such as decals L1–L5 which are closely adjacent each other on the product and which share a common surface, such as those on surface 50 of the control panel 25 shown in FIG. 5. After identifying such closely adjacent decals, the maker consolidates certain of those decals into groups such as the group of decal messages L1, L2 and L3 which have been consolidated into decal D9 in FIG. 6 and the decal messages L4 and L5 which have been consolidated as D19. Each group may then be provided with a single removal cut R around the entire group. Instead of the installer 20 having to install two, three or more individual decals in a small area and try to align and place them in an aesthetically pleasing way, a lesser number of decal groups is applied with all decal messages in each group being compatible, evenly aligned, perfectly placed and aesthetically attractive.

Because all of the margins M surrounding the borders B of the decal messages D1–D19 are provided with product match means, such as a color band substantially color matched to the color of the product 18, the irregular margin M associated with thermal die cut decals is effectively concealed from the eye when the decal is applied to the product and the color of the margin M substantially identically matches the color of the product.

With the use of this aspect of the invention it becomes practical to produce large sheets of decals containing a multiplicity of decal messages since the irregular margins produced by imperfectly centered removal cuts R due to stretching and slippage of the vinyl layer 28 is effectively concealed by the use of the color bands C in gaps G or by other described product match means.

When a product 18 is destined for foreign markets and the decal messages must carry foreign language text, a complete decal tool 10 can be printed which contains decal messages of the same shape but in which foreign text and symbols are substituted for the English text version and the entire set of foreign language decals can be placed on a single decal tool 10. The invention thus eliminates the need for inventorying large numbers of additional separate, individual decals for every major foreign market and the problem of unskilled and sometimes marginally literate installer employees distinguishing one foreign language from another when foreign notices are utilized. If decals containing a first language ever need replacement with decals in a second foreign language, a new set containing the second language can be quickly placed to overlie the old decals.

The invention allows the decal messages associated with the decal tool 10 to be more effective than the previous collage of separate decals because all the decal messages of the tool 10 are manufactured at the same time, have adhesive of the same age and use life, and all text fonts, borders, corners, and color shades can be visually compatible since made at the same time during the same printing.

The invention avoids the prior inventorying problems where a product manufacturer had to stock dozens and at times hundreds of different decals and had to hand select and gather every different decal for each machine and still have no straight forward or reliable way to assure that each model of machine had exactly the decals intended for it. Using the invention, when decals must be reordered by a manufacturer, they can be ordered on the basis of an entire sheet for each product or model instead of on an individual decal basis, thereby reducing the number of inventorying steps, and reducing storage requirements.

In the event the decal requirements for a particular product or model of machine change, only the decal tool 10 associated with that product needs to be changed. This avoids the confusion that occurs when a particular decal is used on several products and a change to one of the products modifies the decal for the changed product but not for the remaining products.

The invention provides an economic solution for proving that a specific decal or group of decals was applied to the product 18 at the time of shipment by the product manufacturer. Because of the presence of the additive 70 in the adhesive on the decals, each time the decals are applied to the surface of a product 18, the additive bonds to the paint of the product or to the surface of the product, leaving a stubborn but invisible residue 72 underlying the decal. In the event that the decal is thereafter removed through no fault of the manufacturer, the invisible residue remains on the surface of the product 18, and when an ultraviolet light source 76 is thereafter shined on the location on which the decal was previously attached, a highly visible footprint 74 will appear. This footprint 74 will have the same shape and configuration as the removed decal, and when the decal is provided with an irregularity zone Z containing protrusions or indentations uniquely associated with the particular decal, it will be thereafter possible to identify the specific decal which was removed from the product.

Accordingly, should a product 18 be involved in an accident or a mishap, and injury occur, the invention allows the manufacturer to quickly determine whether the alleged absence of a critical decal was caused by failure to apply the decal at the time of manufacture or due to spurious subsequent removal of the decal by individuals or instrumentalities beyond the control of the manufacturer.

It is anticipated that various changes and modifications may be made in the construction, arrangement, operation and method of construction of the organization tool disclosed herein without departing from the spirit and scope of the invention as defined in the following claims.

What is claimed is:

1. In combination with a hazardous product decal message application site for the installing of instructional and safety warning decal messages on a hazardous product, a decal organization tool at said application site useable with a hazardous product wherein the hazardous product is of a predetermined color and requires the attachment thereto of a multiplicity of spaced apart instructional and safety warning decal messages unrelated to and different from each other for the protection and education of the user, said decal organization tool decreasing the risk of injury to the user of the product, decreasing the frequency of unfounded product liability claims against a manufacturer of said product, bringing the multiplicity of decal messages as a group to said application site, avoiding decal installation errors by a decal installer and allowing the concealment of irregular margins around the decal messages from a human viewer while maintaining a visually attractive appearance, said tool comprising:

an information layer having an obverse face and a reverse face;

an adhesive applied to said reverse face of said information layer;

a decal liner sheet releasably retained to said information layer by said adhesive;

said information layer including a multiplicity of separate instructional and safety warning decal messages unrelated to and different from each other for the protection and education of the user and containing instructional information associated with the hazardous product and visible by the user whereby all of said multiplicity of said instructional and safety warning decal messages will be available to the installer and on said liner sheet as a group and can be carried to said hazardous product decal message application site as a group;

said instructional and safety warning decal messages being printed adjacent each other on one of said faces of said information layer, each of said multiplicity of instructional and safety warning decal messages having an associated continuous border surrounding and spaced from said instructional information of said decal message with which it is associated;

said borders of said adjacent decal messages being spaced from one another by an intervening gap;

a multiplicity of removal cuts in said information layer, a said removal cut surrounding and associated with each of said decal messages to define the edge of each said associated decal message and to permit removal of each said associated decal message from said information layer and said liner sheet and permit transfer to the hazardous product, each said removal cut being wholly outside and spaced from said border of said associated decal message and within said intervening gap surrounding the associated decal message to define a margin between each said removal cut and said border of said decal message associated with said removal cut;

product match means in said intervening gap on one of said faces of said information layer outside said borders, surrounding and contacting the said borders of a multiplicity of said decal messages and allowing the viewer to see a color in each said margin substantially matching said product predetermined color when said decal messages are affixed to the product, whereby each said decal message is releasably peelable from said liner sheet, and adhereable to the product with the said product match means which surrounds each decal message border allowing color matching of said margins with said predetermined color of said product so that when each said decal message is applied to the product and is viewed at a distance from the product by the user, the said margin between said border and said edge of said associated decal message will color match said predetermined color of the product and no portion of said decal message outside its said border visually color contrasts substantially with the product, thereby effectively visually concealing any irregular margin between said border and said removal cut; and said liner, when stripped bare of said multiplicity of decal messages, becoming an indicator at said decal message application site for the decal installer that all said instructional and safety warning decal messages of said group and on said liner sheet have been applied to the product thereby providing assurance that all the decal messages are attractively applied to the hazardous product and are available for the protection of the user.

2. The combination of claim 1 wherein said product match means includes a color band applied to one of said faces of said information layer, said color band having substantially the color of said predetermined color.

3. The combination of claim 2 wherein said color band extends between and around said multiplicity of decal messages.

4. The combination of claim 1 wherein said product match means includes a base color layer on one of said faces of said information layer, and said base color layer is of substantially said predetermined color.

5. The combination of claim 1 wherein said borders are line borders.

6. The combination of claim 4 wherein said information within a plurality of said borders has a color background using a color other than said predetermined color.

7. The decal organization tool of claim 1 wherein said adhesive contains an additive responsive to ultra violet light, such that when said information layer, said adhesive and said additive of said multiplicity of instructional decal messages have been adhered to the product and thereafter removed from the product, a residue of said additive remains substantially permanently on the product to define a visible footprint on said product and matched to each said instructional decal message when the ultraviolet light is incident on the product, thereby confirming that a multiplicity of said instructional decal messages were applied to the product at the sites of said footprints.

8. The combination of claim 7 wherein said removal cuts surrounding a multiplicity of said decal messages have a continuous regular edge except for a predetermined irregularity zone unique to each of said multiplicity of decal messages so as to identify from the said footprint, the specific decal message which was removed from the product.

9. The combination of claim 8 wherein said irregularity zones are on said margins and of said predetermined product color such that each said irregularity zone blends with the said predetermined color of the product and is substantially visually concealed when said decal message is adhered to the product and viewed at a distance from said decal message.

10. The combination of claim 8 wherein each said irregularity zone includes at least one protrusion extending outward from said edge of said associated decal message.

11. The combination of claim 8 wherein each said irregularity zone includes at least one indentation in said edge of said associated decal message.

12. The combination of claim 8 wherein said irregularity zone includes at least one indentation in and at least one protrusion extending outwardly from said edge of said associated decal message.

13. In combination with a hazardous product decal message application site for the application of instructional and safety warning decal messages on a hazardous product, wherein the hazardous product requires the attachment thereto of a multiplicity of spaced apart, different, instructional and safety warning decal messages containing textual material for the protection and education of the user, a decal organization tool at the said site to decrease the risk of injury to the user and decrease the frequency of unfounded product liability claims against a manufacturer of the hazardous product, to bring the multiplicity of decal messages as a group to said hazardous product decal message application site to avoid decal installation errors, and to allow identification of each decal message applied to the hazardous product in the event certain of said decal messages are later removed from the product, comprising:

an information layer having an obverse face and a reverse face;

a multiplicity of, textual, instructional and safety warning decal messages unrelated to and different from each other and containing information visible to a human user, said decal messages being on one of said faces of said information layer;

an adhesive applied to said reverse face of said information layer;

a decal liner sheet releasably retained by said adhesive;

a multiplicity of removal cuts in said information layer, a said removal cut surrounding and associated with each of said decal messages to define the edge of each said decal message and to permit removal of each said decal message from said information layer and said liner sheet and transfer to the hazardous product;

said adhesive including an additive responsive to ultraviolet light, such that when said adhesive and said additive have been adhered to the hazardous product, and its associated decal message thereafter been removed from the hazardous product, a residue of said additive remains substantially permanently on the hazardous product to form a visible footprint on the hazardous product matching said removed decal message when ultraviolet light is incident on the product, thereby allowing a determination that said removed decal message was applied to the product and that the absence of said removed decal message is not due to any failure to originally place said removed decal message on the product.

14. The combination of claim 13 wherein said removal cuts surrounding a multiplicity of said decal messages have a continuous, regular edge except for a predetermined irregularity zone unique to each of said multiplicity of decal messages so as to identify from the said footprint the specific decal message which was removed from the product.

15. The combination of claim 14 wherein said irregularity zone includes at least one protrusion extending outward from said edge of said associated decal message.

16. The combination of claim 14 wherein said irregularity zone includes at least one indentation in said edge of said associated decal message.

17. The combination of claim 14 wherein said irregularity zone includes at least one indentation in and at least one protrusion extending outwardly from said edge of said associated decal message.

18. The combination of claim 14 wherein the product is of a predetermined color and wherein:

each said decal message includes a border and further includes a margin extending between said border and said edge;

each said margin being of substantially said product predetermined color so said associated irregularity zone will also be of said predetermined color to allow said irregularity zone to blend with said product predetermined color and be visually concealed when said decal message is adhered to the product and viewed at a distance from the product.

19. The combination of claim 14 wherein the product is of a predetermined color and wherein:

each said decal message includes a border and further includes a margin extending between said border and said edge; and said information layer is substantially transparent where said margins coincide with said information layer so said irregularity zone will also be substantially transparent, whereby said irregularity zone will blend with said product predetermined color and be visually concealed when said decal message is adhered to the product and viewed at a distance from the product.

20. The combination of claim 13 and further including a support device for holding said information layer and said liner sheet in an upright orientation at said hazardous product decal message application site for the convenience of the decal installer.

21. The combination of claim 20 wherein said multiplicity of instructional decal messages on said information layer is at least six instructional decal messages.

22. In combination with a hazardous product decal message application site for the installation of instructional and safety warning decal messages on a hazardous product, and wherein the hazardous product requires the attachment thereto of a multiplicity of spaced apart, instructional and safety warning decal messages unrelated to and different from each other for the protection and education of the user of the hazardous product, a decal organization tool at said site to avoid decal installation errors by a decal installer, said tool comprising:

an information layer having an obverse face and a reverse face;

an adhesive applied to said reverse face of said information layer;

a single decal liner sheet on said reverse face and releasably retained to said information layer;

said information layer including a multiplicity of instructional and safety warning decal messages unrelated to and different from one another and descriptively relating to the hazardous product and for the protection and education of the user, said messages printed on one of said faces of said information layer whereby all of said multiplicity of different instructional decal messages will be available to the decal installer on said liner as a group and can be brought to said hazardous product decal message application site as a group;

a multiplicity of removal cuts in said information layer, each said removal cut surrounding and associated with a said different instructional decal message to define the edge of each said associated decal message and to permit removal of each said associated decal message from said information layer and transfer to the hazardous product; and said single liner sheet, when stripped bare of said instructional decal messages, becoming an indicator at said application site for the decal installer that all the said decal messages describing the product and on said liner sheet have been applied to the product, thereby assuring that said instructional decal messages will be applied to the product for the education and protection of the user of the product.

23. The combination of claim 22 and further including a support device for holding said information layer and said liner sheet in an upright orientation for the convenience of the decal installer.

24. The combination of claim 23 wherein said multiplicity of decal messages is at least six decal messages.

25. The decal organization tool of claim 24 wherein said adhesive contains an additive responsive to ultraviolet light, such that when said information layer, said adhesive and said additive of a decal message have been adhered to the product and thereafter removed from the product, a residue of said additive remains substantially permanently on the product to define a visible footprint on the product and matched to said decal message when the ultraviolet light is incident on the product, thereby confirming that a decal message was applied to the product.

26. The decal organization tool of claim 25 wherein said removal cuts surrounding a multiplicity of said decal messages have continuous, substantially geometrically regular edges except for a predetermined irregularity zone unique to each of said multiplicity of decal messages so as to identify from the said footprint, the specific decal message which was removed from the product.

27. In combination with a hazardous product decal message application site for the installation of instructional and safety warning decal messages on a hazardous product, wherein the hazardous product requires the attachment thereto of at least six separate and spaced apart instructional and safety warning decal messages unrelated to and different from each other for the protection and education of the user, a decal organization tool at said site to decrease the risk of injury to the user and decrease the frequency of unfounded product liability claims against a manufacturer of the hazardous product, to bring the decal messages as a group to the hazardous product, decal message application site, and to avoid decal installation errors by a decal installer, said tool comprising:

an information layer having obverse and reverse faces;

an adhesive applied to said reverse face of said information layer for long term adherence of said adhesive and said information layer to the hazardous product when applied to the hazardous product by the decal installer;

a single decal liner sheet releasably retained closely adjacent said information layer;

said information layer including at least six instructional and safety warning decal messages different from one another, relating descriptively to the hazardous product, and including safety warning information visible by the user, said decal messages printed adjacent each other on one of said faces of said information layer;

a multiplicity of removal cuts in said information layer, a said removal cut surrounding and associated with each of said decal messages to define the edge of each said associated instructional and safety warning decal message and to permit removal of each said associated decal message from said information layer and said liner sheet and transfer to the hazardous product, whereby each said decal message is releasably peelable from said single liner sheet and adhereable to the hazardous product, thereby assuring that all of said decal messages may be brought as a group to said hazardous product decal message application site on said liner sheet so the installer will have all of said instructional and safety warning messages available for affixing to the hazardous product; and said liner sheet, when stripped bare of said decal messages, defining an indicator at said application site for the installer that all the said instructional and safety warning decal messages have been applied to the hazardous product and will be with the hazardous product for the education and welfare of the user.

* * * * *